US005818397A

United States Patent [19]

Yarsunas et al.

[11] Patent Number: 5,818,397

[45] **Date of Patent: *Oct. 6, 1998**

[54] CIRCULARLY POLARIZED HORIZONTAL BEAMWIDTH ANTENNA HAVING BINARY FEED NETWORK WITH MICROSTRIP TRANSMISSION LINE

[75] Inventors: George D. Yarsunas, Mount Holly, N.J.; Charles M. Powell, Holland, Pa.

[73] Assignee: Radio Frequency Systems, Inc., Marlboro, N.J.

[ * ] Notice: The term of this patent shall not extend beyond the expiration date of Pat. No. 5,481,272.

[21] Appl. No.: 545,161

[22] Filed: Oct. 19, 1995

Related U.S. Application Data

[63] Continuation-in-part of Ser. No. 420,439, Apr. 10, 1995, Pat. No. 5,481,272, which is a continuation of Ser. No. 119,710, Sep. 10, 1993, abandoned.

[51] Int. Cl.[6] ..... H01Q 21/26

[52] U.S. Cl. ..... 343/797; 343/789; 343/795; 343/872

[58] Field of Search ..... 343/797, 789, 343/795, 872, 700 MS, 798, 803, 806, 810, 812, 813; H01Q 21/26

[56] References Cited

U.S. PATENT DOCUMENTS

| | | | |
|---|---|---|---|
| 2,130,033 | 9/1938 | Scharlau | 343/813 |
| 2,412,090 | 12/1946 | Kibler | 343/797 |

(List continued on next page.)

FOREIGN PATENT DOCUMENTS

| | | |
|---|---|---|
| 1236535 | 6/1960 | France . |
| 2034125 | 5/1980 | United Kingdom . |

OTHER PUBLICATIONS

Simple Antenna for Circular Polarisation, *8049h IEEE Proceedings Part H,* vol. 139, NO. 2, Apr. 1992, Stevenage, Herts., GB.

Johnson, *Antenna Engineering Handbook,* 1984, pp. 23–2/23–17.

(List continued on next page.)

*Primary Examiner*—Hoanganh T. Le
*Attorney, Agent, or Firm*—Ware, Fressola, Van Der Sluys & Adolphson LLP

[57] ABSTRACT

A circularly polarized antenna has an open reflector box, an array of crossed dipoles, and a single binary feed network. The open reflector box is formed of conductive material, has a ground plate and four side walls defining an opening, and has an input port for receiving an input signal. The single binary feed network is disposed within the open reflector box, is connected to the input port, and has a microstrip transmission line spaced from the ground plate. The microstrip transmission line has conductive bars mounted parallel to the ground plate and spaced therefrom forming an air dielectric low loss microstrip. Each pair of crossed dipoles has a first dipole comprising two downwardly bent radiating elements arranged at an angle with respect to the ground plate, and has a second dipole comprising two straight radiating elements arranged parallel to the ground plate. Each pair of crossed dipoles also has a pair of phase loop connectors and standoffs for respectively connecting an associated downwardly bent radiating element of the first dipole to a corresponding straight radiating element of the second dipole for providing circular polarization in an axial direction. One downwardly bent radiating element is connected to the ground plate, and another downwardly bent radiating element is connected to a respective conductive bar of the single binary feed network, for providing a circularly polarized horizontal beamwidth pattern having a horizontal width determined by the angle of the downwardly bent radiating elements with respect to the ground plate.

7 Claims, 18 Drawing Sheets

U.S. PATENT DOCUMENTS

| | | | |
|---|---|---|---|
| 2,455,403 | 12/1948 | Brown | 343/820 |
| 3,474,447 | 10/1969 | Melancon | 343/893 |
| 3,482,253 | 12/1969 | Zucconi | 343/834 |
| 3,496,570 | 2/1970 | Lewis | 343/754 |
| 3,681,771 | 8/1972 | Lewis et al. | 343/817 |
| 3,701,157 | 10/1972 | Uhriq | 343/708 |
| 3,740,754 | 6/1973 | Epis | 343/797 |
| 3,747,114 | 7/1973 | Shyhalla | 343/795 |
| 3,750,185 | 7/1973 | Evans | 343/814 |
| 3,836,970 | 9/1974 | Reitzig | 343/854 |
| 3,854,140 | 12/1974 | Ranghelli et al. | 343/756 |
| 3,858,218 | 12/1974 | Masak et al. | 343/854 |
| 3,997,900 | 12/1976 | Chin et al. | 343/705 |
| 4,031,537 | 6/1977 | Alford | 343/704 |
| 4,031,539 | 6/1977 | Woodward | 343/797 |
| 4,032,922 | 6/1977 | Provencher | 343/854 |
| 4,062,019 | 12/1977 | Woodward et al. | 343/797 |
| 4,063,243 | 12/1977 | Anderson et al. | 343/876 |
| 4,218,685 | 8/1980 | Ellis. Jr. | 343/727 |
| 4,231,040 | 10/1980 | Walker | 343/854 |
| 4,316,192 | 2/1982 | Acoraci | 343/854 |
| 4,477,813 | 10/1984 | Weiss | 343/700 MS |
| 4,495,502 | 1/1985 | Masak | 342/380 |
| 4,518,969 | 5/1985 | Bogner | 343/819 |
| 4,596,986 | 6/1986 | Andrews et al. | 342/373 |
| 4,633,257 | 12/1986 | Apostolos et al. | 342/445 |
| 4,710,775 | 12/1987 | Coe | 343/727 |
| 4,882,588 | 11/1989 | Renshaw et al. | 342/373 |
| 4,905,014 | 2/1990 | Gonzales et al. | 343/909 |
| 4,929,961 | 5/1990 | Nakase | 343/715 |
| 5,115,248 | 5/1992 | Roederer | 342/373 |
| 5,255,004 | 10/1993 | Berkowitz et al. | 343/853 |
| 5,274,391 | 12/1993 | Connolly | 343/820 |
| 5,353,032 | 10/1994 | Bertocchi et al. | 342/373 |
| 5,481,272 | 1/1996 | Yarsunas | 343/797 |

OTHER PUBLICATIONS

Hall et al., *The ARRL Antenna Book,* 15th Edition, 1988 no month pp. 2–12/2–24, pp. 19–8/19–10.

Hall et al., *The AARL Antenna Book,* 1983, pp. 2/9, no month and pp. 5–7/5–22.

Moxon, "HF Antennas For All Locations", *Radio Society of Great Britain,* 1984, pp. 41–42. no month.

Johnson, *Antenna Engineering Handbook,* 1984, Chapter 43, no month pp. 43–1/43–5, 43–23/43–32, and pp. 42–9/42–10.

120° HORIZONTAL BEAMWIDTH
PATTERN AT 859 MEGAHERTZ (3dB)

CIRCULARLY POLARIZED HORIZONTAL BEAMWIDTH ANTENNA HAVING BINARY FEED NETWORK WITH MICROSTRIP TRANSMISSION LINE

This is a continuation-in-part application of U.S. Ser. No. 08/420,439, filed Apr. 10, 1995, now U.S. Pat. No. 5,481,272 which is a continuation of U.S. Ser. No. 08/119,710, filed Sep. 10, 1993, now abandoned, both hereby incorporated by reference.

BACKGROUND OF THE INVENTION

1. Field of the Invention

The present invention relates to circularly polarized antennae and, more particularly, to a circularly polarized antenna having an array of crossed dipoles connected by a binary feed network with a microstrip transmission line.

2. Description of the Prior Art

The use of cellular telephone communications systems has increased dramatically in recent years. In conjunction with this increased use, the number of cellular telephone transmission sites has also increased. Associated with each cellular telephone transmission site are a number of antennae for transmitting signals in the cellular telephone frequency band of the electromagnetic spectrum. It may be advantageous in the cellular telephone communications industry for these antennae to transmit these signals in a circularly polarized manner.

Circular polarization of electromagnetic signals transmitted from cellular telephone antennae may be achieved with a pair of crossed, one-half wavelength, dipoles that are fed with equal currents from a synchronous source so as to result in quadrature phasing. The standard method of feeding these dipole pairs is to run a separate feed-line to each dipole pair, with the two feed-lines having a 90° phase length difference between them. However, running a separate feed-line to each dipole pair can be both cumbersome and costly with regard to equipment expenditures and maintenance. It also reduces the impedance bandwidth of the antenna.

SUMMARY OF THE INVENTION

One object of the present invention is to provide a circularly polarized antenna which overcomes the above-mentioned shortcomings of using separate feed-lines for each dipole pair in the generation of circularly polarized electromagnetic signals.

The present invention contemplates such a circularly polarized antenna that includes an open reflector box, an array of crossed dipoles, and a single binary feed network.

The open reflector box is formed of conductive material, has a ground plate and four side walls defining an opening, and has an input port for receiving an input signal.

The single binary feed network is disposed within the open reflector box and connected to the input port, and has a microstrip transmission line spaced from the ground plate.

The microstrip transmission line has conductive bars mounted parallel to the ground plate and spaced therefrom forming an air spaced dielectric in the form of an air dielectric low loss microstrip.

In the array, each pair of crossed dipoles has a second dipole comprising two straight radiating elements arranged parallel to the ground plate, and has a first dipole comprising two downwardly bent radiating elements arranged at an angle with respect to the ground plate. Each pair of crossed dipoles also has a pair of phase loop connectors for respectively connecting a corresponding straight radiating element of the second dipole to an associated downwardly bent radiating element of the first dipole for providing circular polarization in an axial direction. One of the downwardly bent radiating elements of the first dipole is connected to the ground plate, and the other of the downwardly bent radiating elements of the first dipole is connected to a respective conductive rod of the single binary feed network, for providing a circularly polarized horizontal beamwidth pattern having a horizontal width determined by the degree of the angle of the downwardly bent radiating elements with respect to the ground plate.

Accordingly, one advantage of the present invention is that the circularly polarized antenna only requires a single feed-line for the generation of circularly polarized electromagnetic signals.

Other objectives and advantages of the present invention will become apparent to those skilled in the art upon reading the following detailed description and claims, in conjunction with the accompanying drawings which are appended hereto.

BRIEF DESCRIPTION OF THE DRAWINGS

In order to facilitate a fuller understanding of the present invention, reference is now made to the appended drawings. These drawings should not be construed as limiting the present invention, but are intended to be exemplary only.

BEST MODE OF THE INVENTION

The subject matter shown in FIGS. 1–20 was originally filed in U.S. Ser. No. 08/420,439, filed Apr. 10, 1995, claiming benefit to U.S. Ser. No. 08/119,710, filed Sep. 10, 1993, now abandoned, both hereby incorporated by reference. The subject matter of the claims in the instant application is shown in FIGS. 21–31, and described below.

FIGS. 1–20

Figure 2:
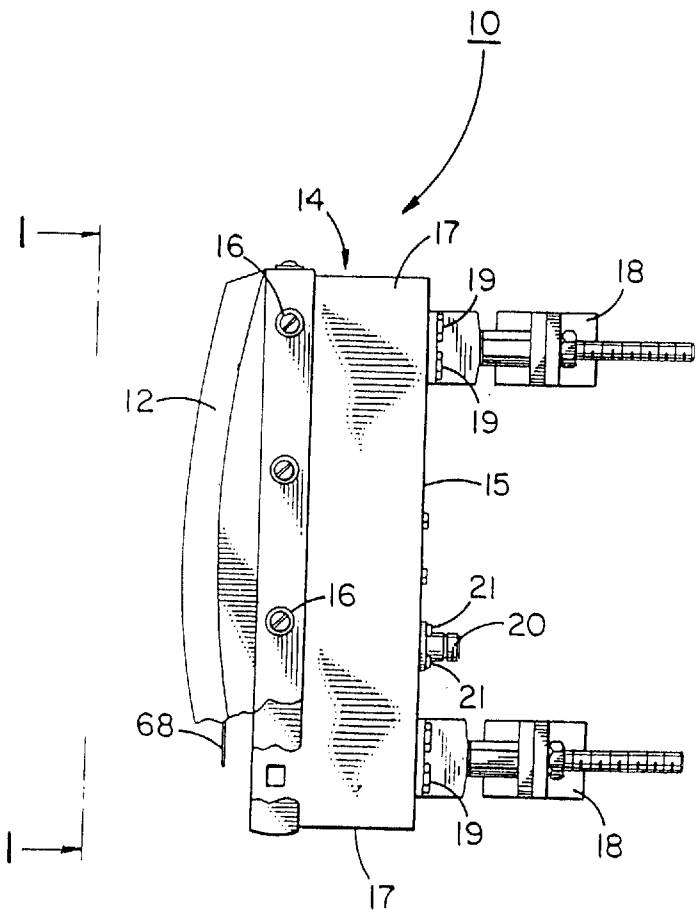
FIG. 2 is a partial breakaway side view of the fully assembled circularly polarized microcell antenna shown in FIG. 1, taken along line 2—2 of FIG. 1.
Figure 1:
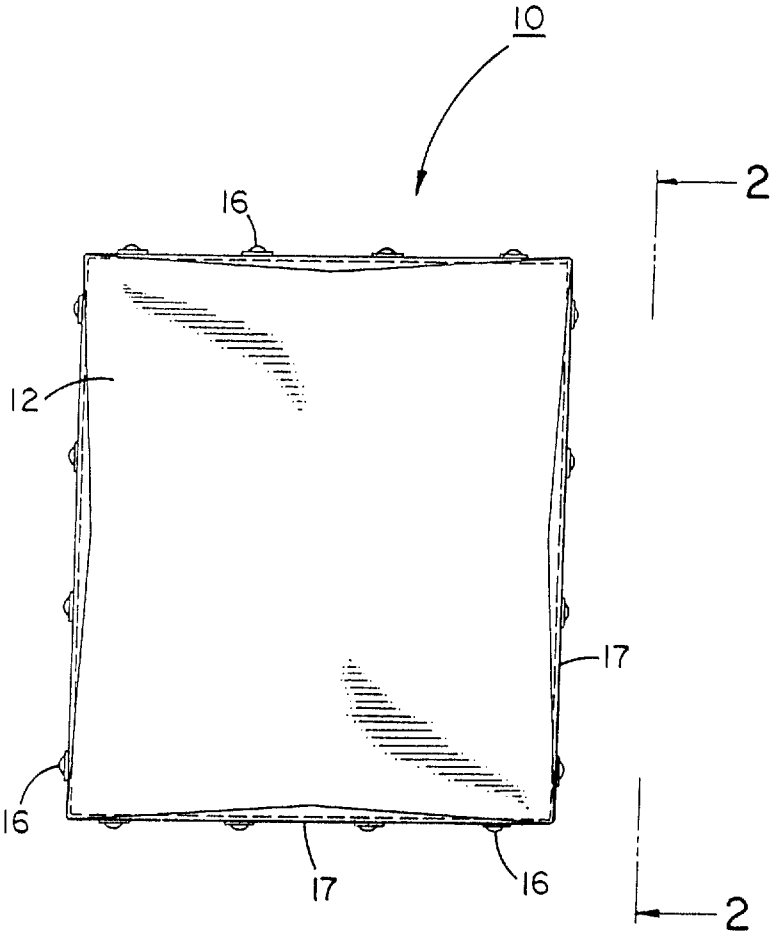
FIG. 1 is a top view of a fully assembled circularly polarized microcell antenna taken along line 1—1 of FIG. 2.

Referring to FIGS. 1 and 2, there is shown a top and a side view, respectively, of a fully assembled circularly polarized microcell antenna 10 according to the present invention. In these views, the antenna 10 is shown having a radome 12 that is secured to a reflector box 14 with a plurality of mounting screws 16. The radome 12 is secured to the reflector box 14 in this manner so as to shield the inside of the box 14 from the elements, since the antenna 10 is generally deployed outdoors. Inside the reflector box 14, covered by the radome 12, a pair of crossed dipoles are mounted and generally indicated as 13 (see FIGS. 3 and 4). Secured to the bottom of the reflector box 14 are a pair of mounting brackets 18 and an electrical connector 20. The mounting brackets 18 are used to secure the antenna 10 at a transmission site, generally a transmission tower. The electrical connector 20, typically a coaxial connector, allows a single feed-line to be electrically connected to the pair of crossed dipoles 13. The mounting brackets 18 are secured to the reflector box 14 with bolts 19, while the electrical connector 20 is secured to the reflector box 14 with screws 21.

Figure 4:
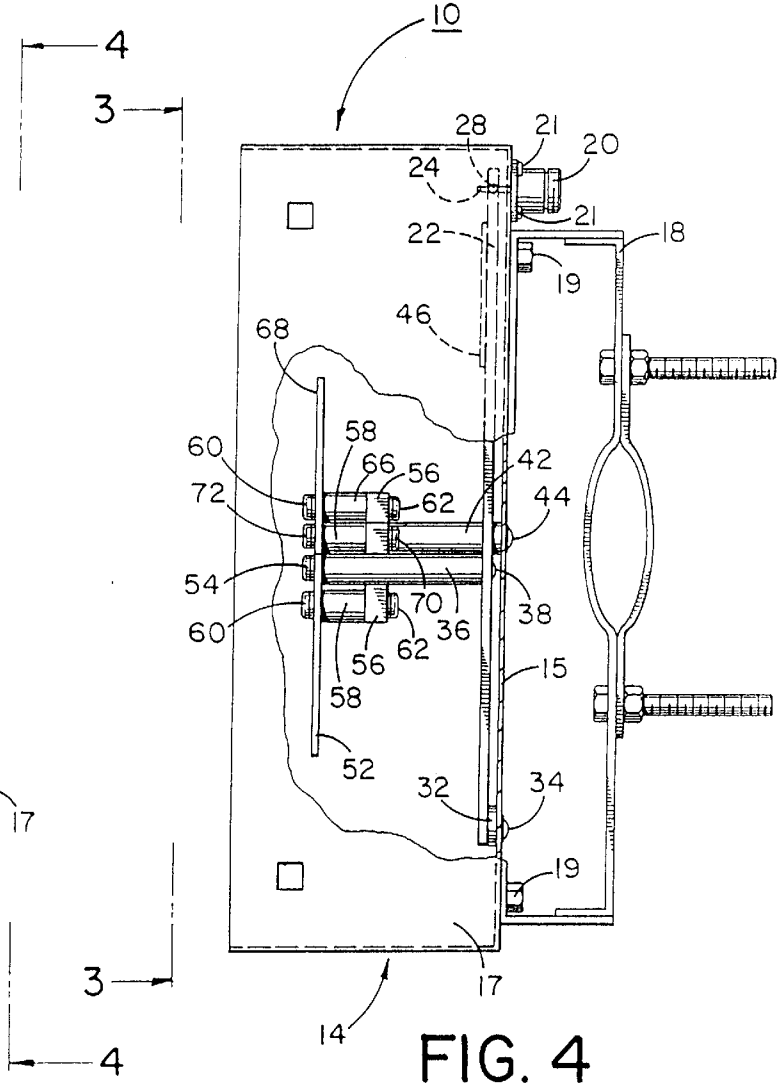
FIG. 4 is a partial breakaway side view of the circularly polarized microcell antenna shown in FIG. 3, taken along line 4—4 of FIG. 3.
Figure 3:
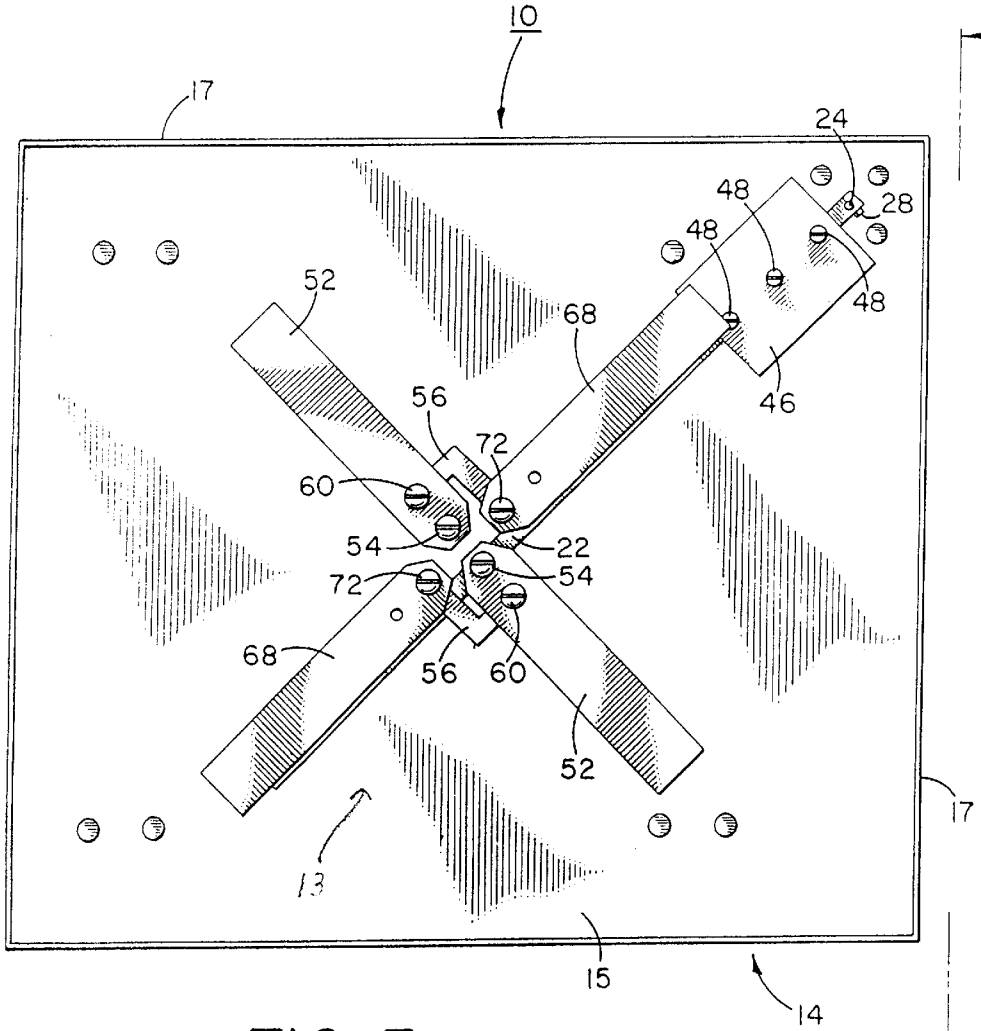
FIG. 3 is a top view of the circularly polarized microcell antenna shown in FIG. 1 with the radome removed, taken along line 3—3 of FIG. 4.

Referring to FIGS. 3 and 4, there is shown a top and a side view, respectively, of the circularly polarized microcell antenna 10 with the radome 12 removed. In these views, the antenna 10 is shown having a conductor bar 22, typically a microstrip line conductor, that is electrically connected at one end to the center conductor 24 of the electrical connector 20. This electrical connection is made by mating the center conductor 24 with a hole 26 (see FIG. 7) which has been vertically bored through the conductor bar 22, and then securing the center conductor 24 within the hole 26 by tightening a set screw 28 against the center conductor 24. The set screw 28 is positioned in a threaded hole 30 (see FIG. 8) which has been horizontally bored into the side of the conductor bar 22 such that it is intersecting with the hole 26. The other end of the conductor bar 22 is secured to the reflector box 14 through a spacer 32 with a screw 34. The screw 34 mates with a threaded hole 35 (see FIG. 7) which has been vertically bored through the conductor bar 22. The spacer 32, along with all the other components in the antenna 10 except the radome 12 which is preferably made of fiberglass, is made of an electrically conductive material, preferably aluminum. Thus, an electrical connection is made between the conductor bar 22 and the reflector box 14 through the spacer 32.

Near the center of the conductor bar 22, a countersunk hole 40 (see FIG. 7) is vertically bored through the conductor bar 22 such that one end of a first standoff 36 may be secured thereto with a screw 38 without electrical contact being made with the reflector box 14. Near the center of the reflector box 14, alongside where the first standoff 36 is secured to the conductor bar 22, one end of a second standoff 42 is secured to the reflector box 14 with a screw 44. Both ends of the first standoff 36 and the second standoff 42 have threaded holes 39 (see FIGS. 11 and 12) formed therein which allow the screws 38, 44, respectively, to mate therewith. Since, as previously described, the components in the antenna 10 are made of an electrically conductive material, an electrical connection is made between the first standoff 36 and the conductor bar 22 and between the second standoff 42 and the reflector box 14.

At this point, it should be noted that the shell casing of the electrical connector 20 is electrically ground, and the electrical connector 20 is secured to the reflector box 14 so as to form an electrical connection therebetween. Thus, the reflector box 14 is considered to be an electrical ground with respect to the center conductor 24. It should also be noted that the first standoff 36 and the second standoff 42 are secured at designated one-quarter wavelength locations on the conductor bar 22 and the reflector box 14, respectively, with respect to a standing wave that is generated along the conductor bar 22, and hence within the reflector box 14, from a signal supplied by the single feed-line. Thus, the first standoff 36 and the second standoff 42 are secured to the conductor bar 22 and the reflector box 14, respectively, at locations where the voltage component of the standing wave is at its peak. It should further be noted that the electrical connector 20, and hence the single feed-line, typically have a characteristic impedance of 50 Ω. To match this impedance, a trim element 46 is secured to the conductor bar 22 so as to act as a capacitor or an impedance transformer to bring the impedance of the antenna 10 in line with that of the electrical connector 20. The trim element 46 is secured to the conductor bar 22 with several screws 48. The screws 48 mate with corresponding threaded holes 50 (see FIG. 7) which have been vertically bored into the conductor bar 22.

Figure 6:
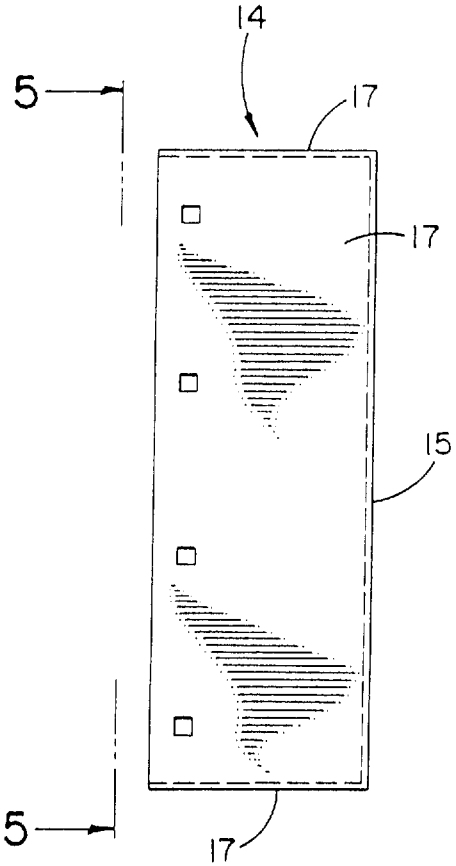
FIG. 6 is a side view of the reflector box shown in FIG. 5, taken along line 6—6 of FIG. 5.
Figure 5:
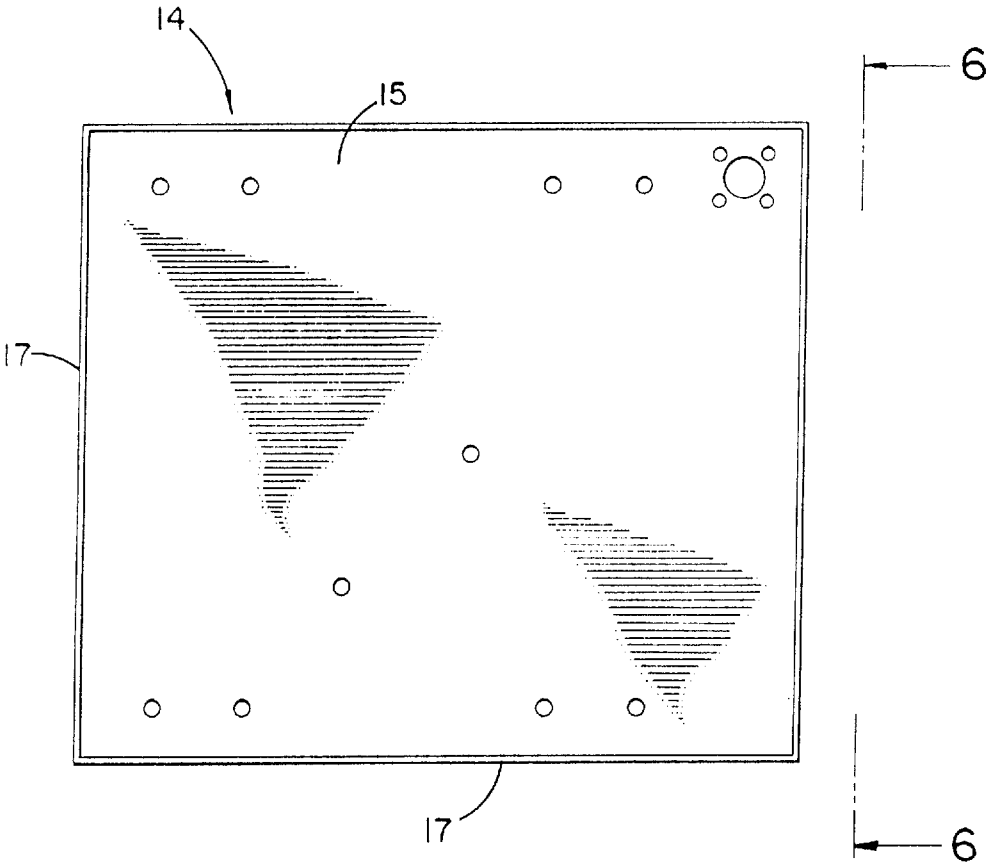
FIG. 5 is a top view of the reflector box used in the circularly polarized microcell antenna shown in FIG. 1, taken along line 5—5 of FIG. 6.
Figure 7:
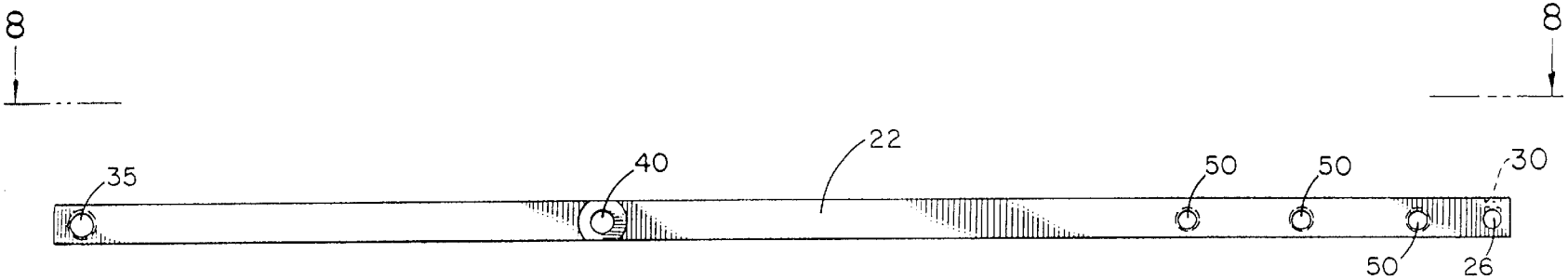
FIG. 7 is a bottom view of the conductor bar used in the circularly polarized microcell antenna shown in FIG. 1, taken along line 7—7 of FIG. 8.
Figure 8:
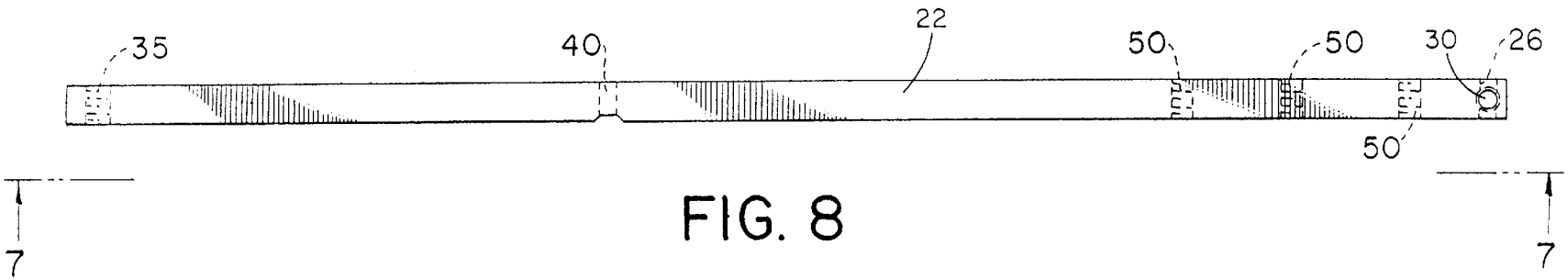
FIG. 8 is a side view of the conductor bar shown in FIG. 7, taken along line 8—8 of FIG. 7.
Figure 9:
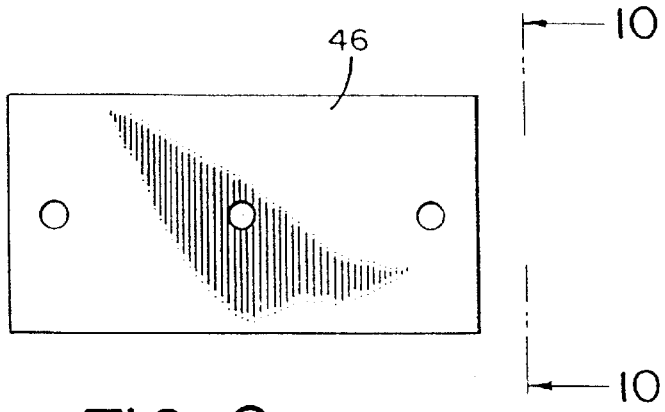
FIG. 9 is a top view of the trim element used in the circularly polarized microcell antenna shown in FIG. 1, taken along line 9—9 of FIG. 10.
Figure 10:
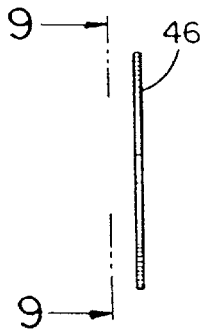
FIG. 10 is a side view of the trim element shown in FIG. 9, taken along line 10—10 of FIG. 9.
Figure 11:
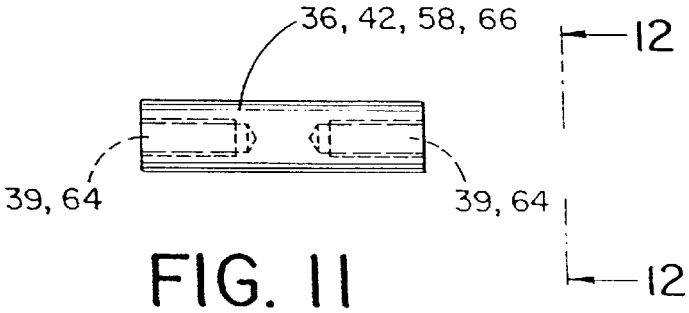
FIG. 11 is a side view of a standoff used in the circularly polarized microcell antenna shown in FIG. 1, taken along line 11—11 of FIG. 12.
Figure 12:
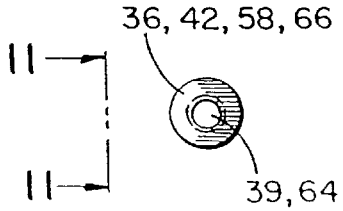
FIG. 12 is an end view of the standoff shown in FIG. 11, taken along line 12—12 of FIG. 11.

Referring to FIGS. 5 and 6, there is shown a top and a side view, respectively, of the reflector box 14 with the location of the mounting holes for the radome 12, the mounting brackets 18, the electrical connector 20, the conductor bar 22, and the second standoff 42 indicated. Referring to FIGS. 7 and 8, there is shown a bottom and a side view, respectively, of the conductor bar 22 with the location of the holes for the center conductor 24, the first standoff 36, and the trim element 46 indicated. Referring to FIGS. 9 and 10, there is shown a top and a side view, respectively, of the trim element 46 with the location of the mounting holes to the conductor bar 22 indicated.

Referring back to FIGS. 3 and 4, at the other end of both the first standoff 36 and the second standoff 42 there is secured a dipole arm 52. These two dipole arms 52 are secured to their respective standoffs 36, 42 with screws 54 that mate with the threaded holes 39 (see FIGS. 11 and 12) formed in the ends of the standoffs 36, 42. These two dipole arms 52 form the primary dipole in the pair of crossed dipoles.

Secured to each dipole arm 52 in the primary dipole is a third standoff 58 which in turn has one end of a phase loop element 56 secured thereto. Each third standoff 58 is secured to each primary dipole arm 52 with a screw 60, and each phase loop element 56 is secured to each third standoff 58 with a screw 62. Similar to the first standoff 36 and the second standoff 42, each third standoff 58 has threaded holes 64 (see FIGS. 11 and 12) formed therein which mate with the screws 60, 62. At this point, it should be noted that the first standoff 36, the second standoff 42, the third standoff 58, and, as will be described shortly, the fourth standoff 66 only differ in their respective lengths. Thus, referring to FIGS. 11 and 12, the elements of the first standoff 36, the second standoff 42, the third standoff 58, and the fourth standoff 66 are all indicated.

Referring again to FIGS. 3 and 4, at the other end of each phase loop element 56 there is secured a fourth standoff 66 which in turn has a secondary dipole arm 68 secured thereto. Each fourth standoff 66 is secured to each phase loop element 56 with a screw 70, and each secondary dipole arm 68 is secured to each fourth standoff 66 with a screw 72. It should be noted that each fourth standoff 66 is physically identical to each third standoff 58, although they have been designated differently for purposes of figure clarity. Thus, similar to the third standoff 58, each fourth standoff 66 has threaded holes 64 (see FIGS. 11 and 12) formed therein which mate with the screws 70, 72. It should also be noted that each secondary dipole arm 68 is physically identical to each primary dipole arm 52, although they have been designated differently for purposes of figure clarity. It should further be noted that these two secondary dipole arms 52, 68 form the secondary dipole in the pair of crossed dipoles.

Figure 13:
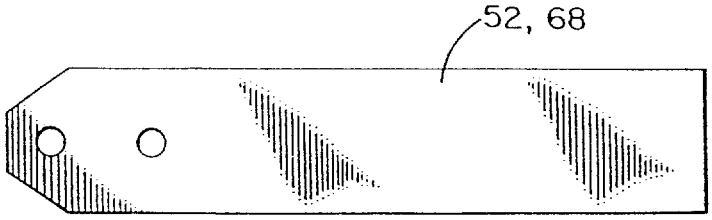
FIG. 13 is a top view of a dipole arm used in the circularly polarized microcell antenna shown in FIG. 1.
Figure 14:
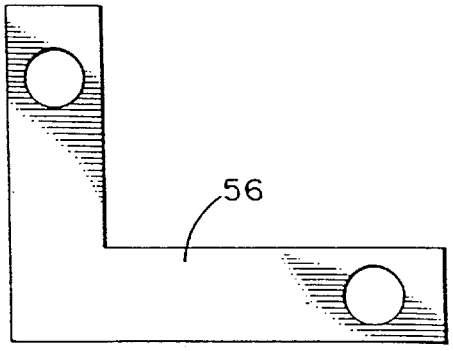
FIG. 14 is a top view of a phase loop element used in the circularly polarized microcell antenna shown in FIG. 1.
Figure 15:
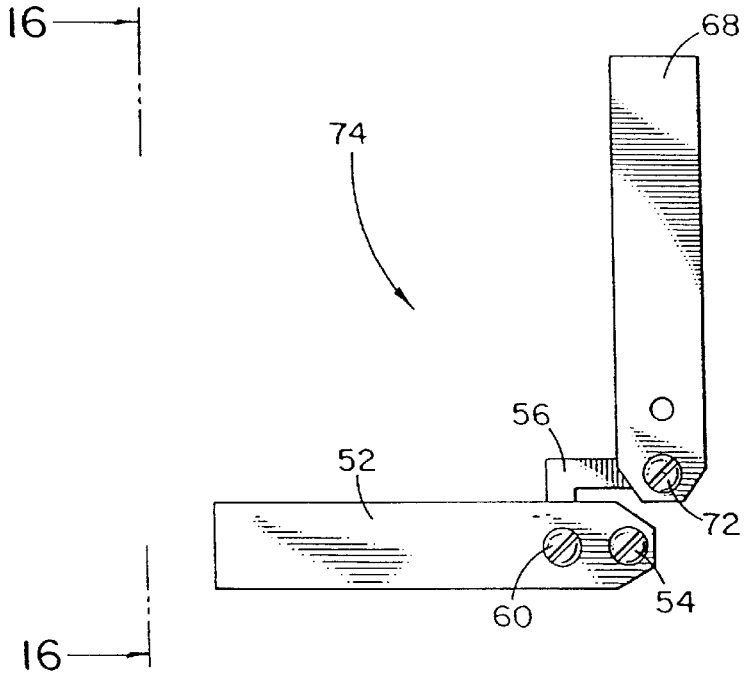
FIG. 15 is a top view of a dipole assembly used in the circularly polarized microcell antenna shown in FIG. 1, taken along line 15—15 of FIG. 16.
Figure 16:
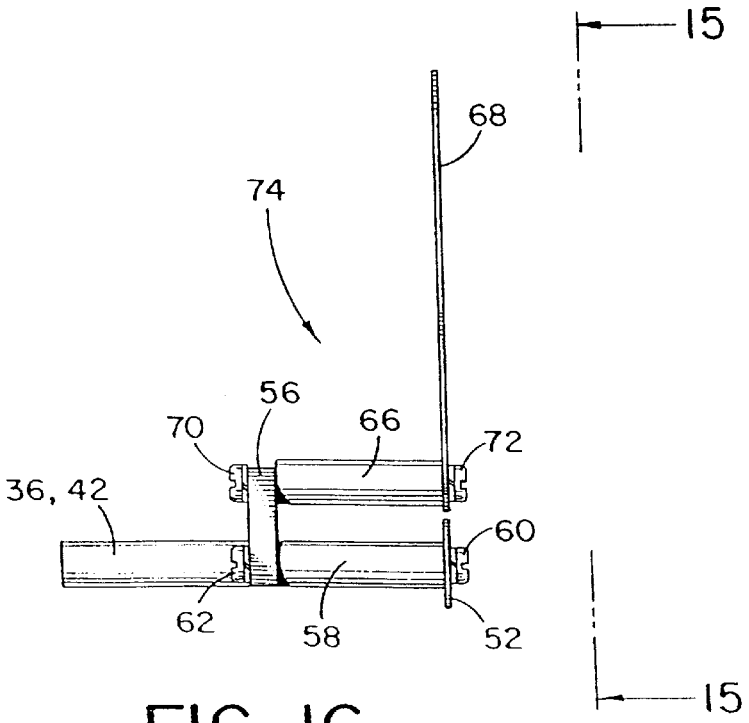
FIG. 16 is a side view of the dipole assembly shown in FIG. 15, taken along line 16—16 of FIG. 15.

Referring to FIG. 13, there is shown a top view of both a primary dipole arm 52 and a secondary dipole arm 68, with the location of the mounting holes to the standoffs 36, 42, 58, 66 indicated. Referring to FIG. 14, there is shown a top view of a phase loop element 56 with the location of the mounting holes to the standoffs 58, 66 indicated. Referring to FIGS. 15 and 16, there is shown a top and a side view, respectively, of a dipole assembly 74, of which there are two in the antenna 10, having a primary dipole arm 52, a secondary dipole arm 68, a third standoff 58, a phase loop element 56, a fourth standoff 66, mounting screws 54, 60, 62, 70, 72, and either a first standoff 36 or a second standoff 42. The length difference between a first standoff 36 and a second standoff 42 is such that all of the secondary dipole arms 52, 68 must lie in the same vertical plane. In other words, the second standoff 42 is longer than the first standoff 36 so as to compensate for their different mounting arrangements (i.e. the first standoff 36 is mounted to the conductor bar 22, while the second standoff 42 is mounted to the reflector box 14).

The most critical aspect of the antenna 10 is the dimensioning of specific component parts, namely the dipole arms 52, 68, the standoffs 36, 42, 58, 66, and the phase loop element 56. In order to correctly dimension these component parts, the center of the operating frequency range of the antenna 10 must be determined. In the case of cellular telephone communications, the operating frequency band ranges from 824 MHz to 894 MHz. Thus, the center of the operating frequency range is 859 MHz, which corresponds to a 13.7402 inch wavelength. With the center frequency, and thus the wavelength, known, the dimensions of the primary dipole arms 52 and the secondary dipole arms 68 can be readily determined. The use of one-half wavelength dipoles requires that the effective distance, or length, between the feed point on each dipole arm 52, 68 and the end of each dipole arm 52, 68 be one-quarter of the above said wavelength. By adding together the effective length of the two primary dipole arms 52 and by adding together the effective length of the two secondary dipole arms 52, 68, a pair of crossed one-half wavelength dipoles are established.

Each arm of the secondary dipole is fed by tapping the standing wave signal from a corresponding arm in the primary dipole. This signal is tapped through a pair of identical phasing loops, one for each arm, each being comprised of a phase loop element 56, a third standoff 58, and a fourth standoff 66. In order for the antenna 10 to achieve circular polarization, each phasing loop must provide a one-quarter wavelength delay, or a 90° phase shift, between the primary dipole arm 52 and the corresponding secondary dipole arm 68. Thus, the dimensions of each phasing loop must have an effective length of one-quarter of the above said wavelength. That is, the effective lengths of the phase loop element 56, the third standoff 58, and the fourth standoff 66 must add up to be one-quarter of the above said wavelength.

At this point, it should be noted that the effective lengths of the phasing loops and the dipole arms 52, 68 are largely dependent upon the current flow through the component parts. Thus, the effective lengths of the phasing loops and the dipole arms 52, 68 are often determined through experimental measurements instead of through mere physical dimensioning. It should also be noted that, although the circularly polarized microcell antenna 10 has been described herein as being used for cellular communications, the antenna concepts described herein may also be applied to other frequency bands with only dimensional changes being required.

Figure 17:
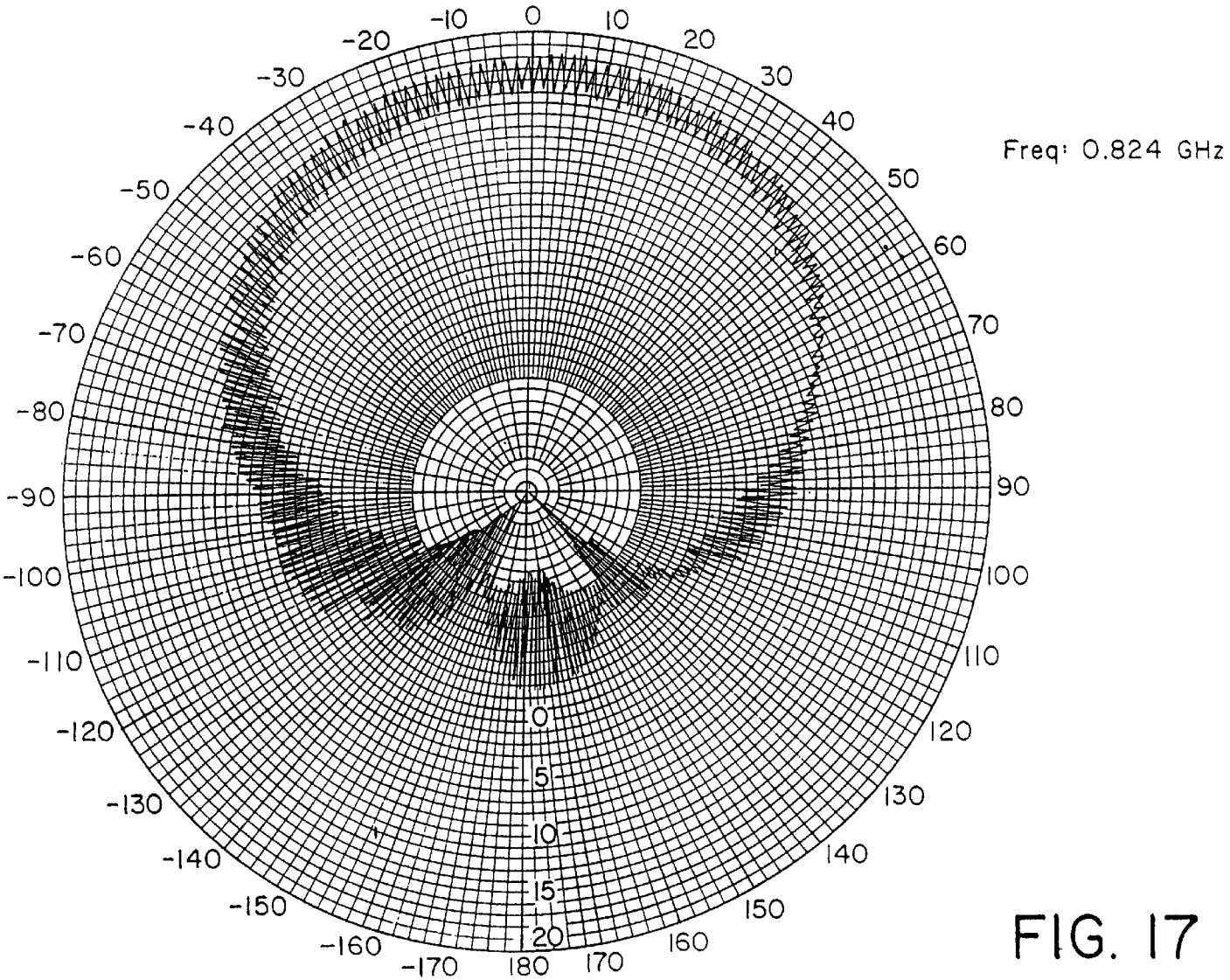
FIG. 17 shows a horizontal beamwidth pattern of the circularly polarized microcell antenna shown in FIG. 1, taken at 824 MHz.
Figure 18:
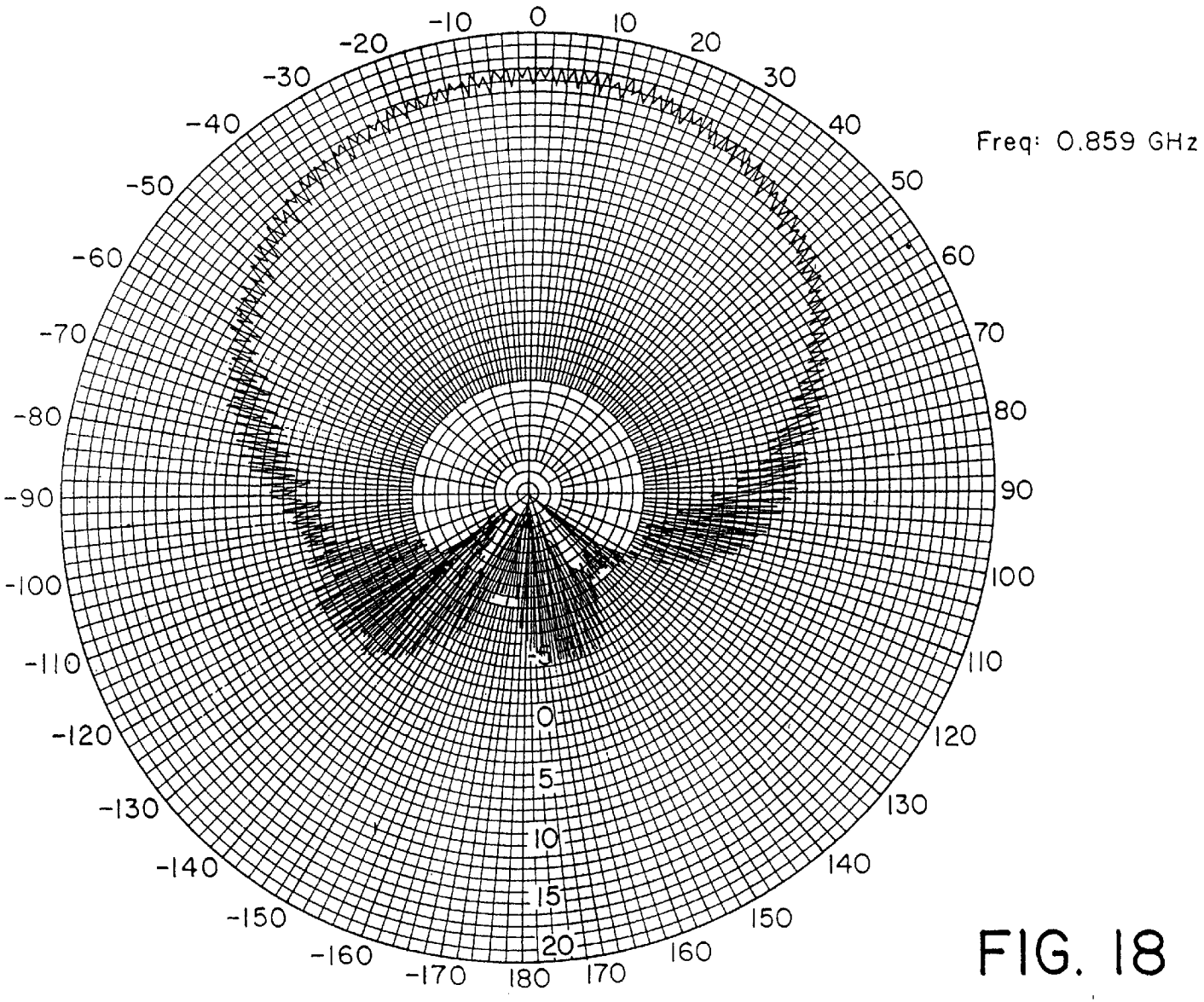
FIG. 18 shows a horizontal beamwidth pattern of the circularly polarized microcell antenna shown in FIG. 1, taken at 859 MHz.
Figure 19:
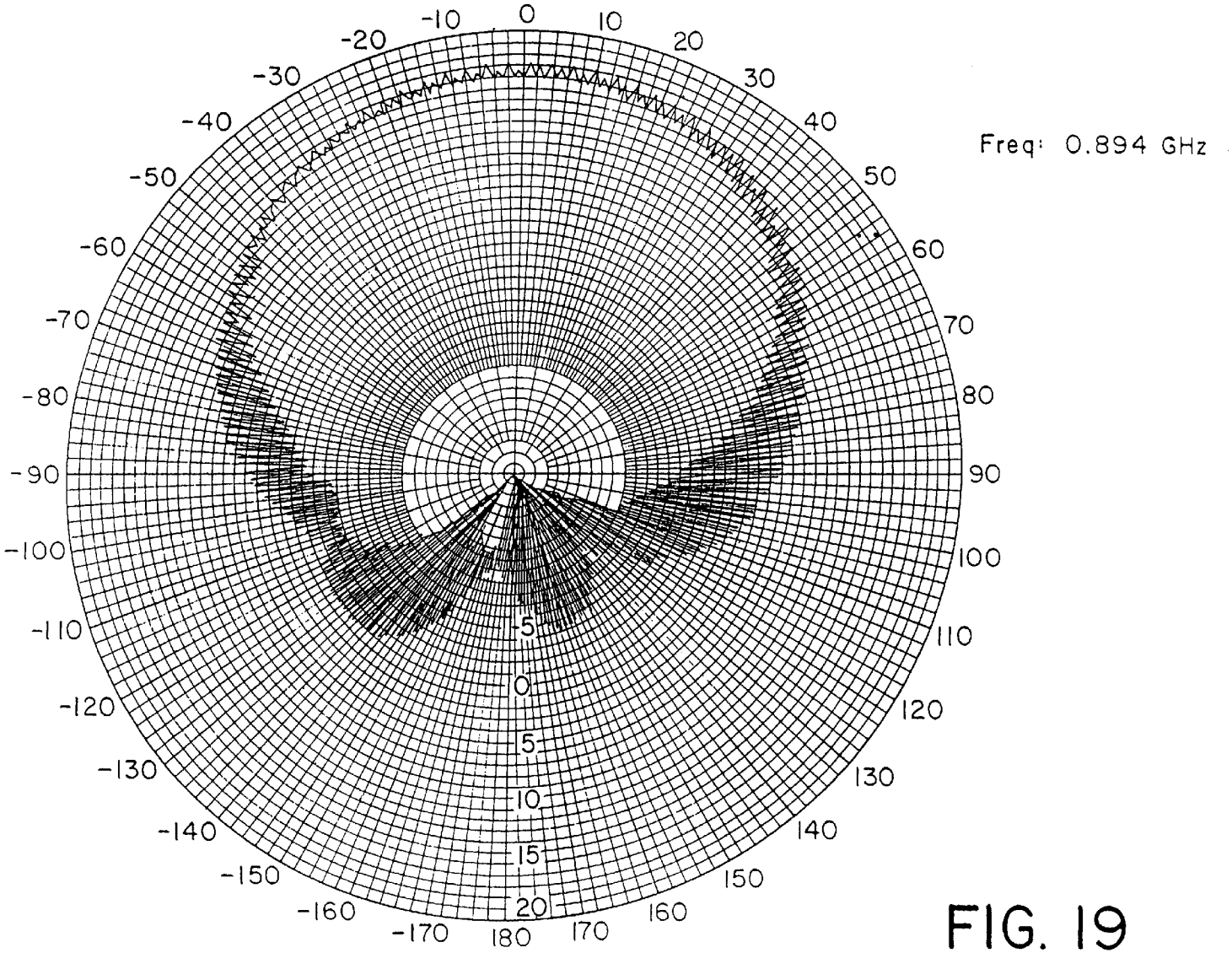
FIG. 19 shows a horizontal beamwidth pattern of the circularly polarized microcell antenna shown in FIG. 1, taken at 894 MHz.
Figure 20:
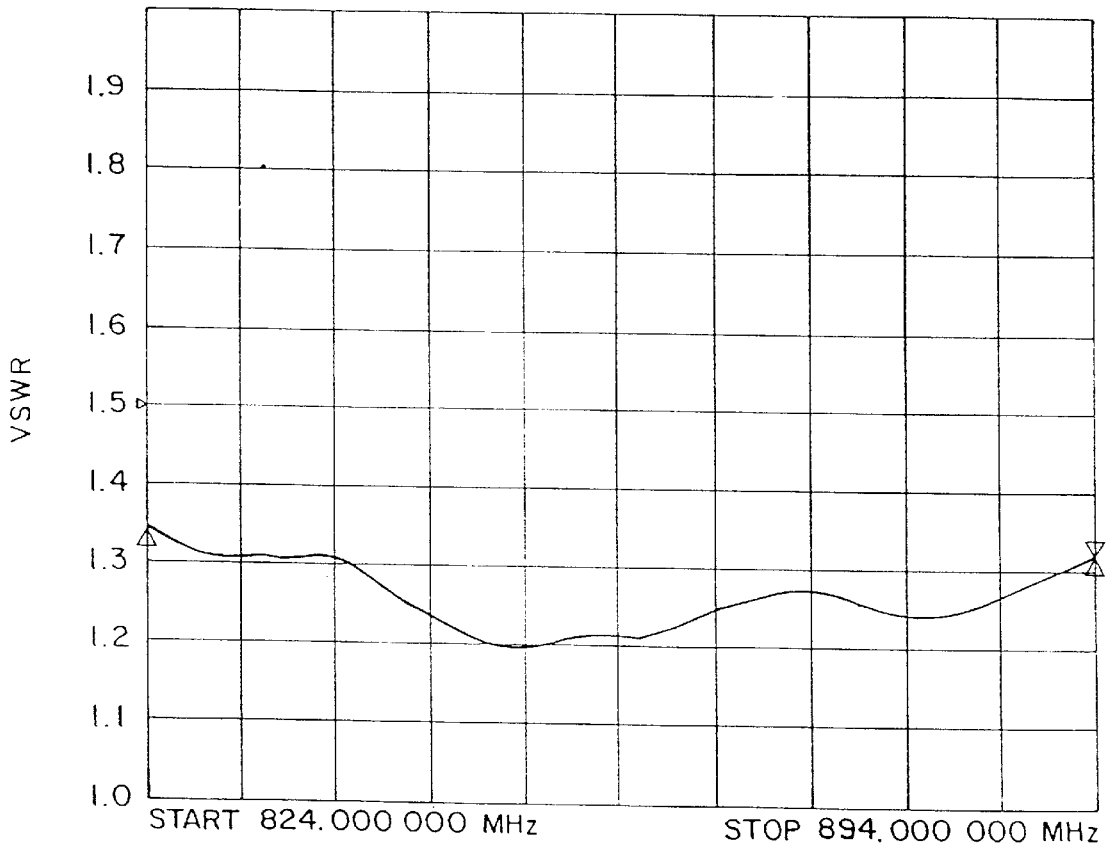
FIG. 20 is a graph of the voltage standing wave ratio of the circularly polarized microcell antenna shown in FIG. 1, taken over the range from 824 MHz to 894 MHz.

Referring to FIGS. 17, 18 and 19, measured horizontal beamwidth patterns of the circularly polarized microcell antenna 10 just described are shown at 824 MHz, 859 MHz, and 894 MHz, respectively. From these patterns, it can be seen that the 3 dB beamwidth of the antenna 10 over the cellular frequency band is approximately 75°. Referring to FIG. 20, a graph of the measured voltage standing wave ratio (VSWR) of the circularly polarized microcell antenna 10, just described, is shown over the range from 824 MHz to 894 MHz. According to industry standards, a VSWR of under 1.5, which is demonstrated here, indicates a good impedance match. Thus, the circularly polarized microcell antenna 10 described herein can radiate circularly polarized electromagnetic signals having a horizontal beamwidth of 75° with a VSWR of less than 1.5 over the cellular frequency band.

FIGS. 21–31

FIGS. 21–31 show a circularly polarized 120 degree horizontal beamwidth antenna generally indicated as 100 for use in cellular communication applications. In one particular application, three 120 degree horizontal beamwidth antennae 100 are typically arranged on a tower to provide 360 degree cellular coverage to a surrounding area.

Figure 29:
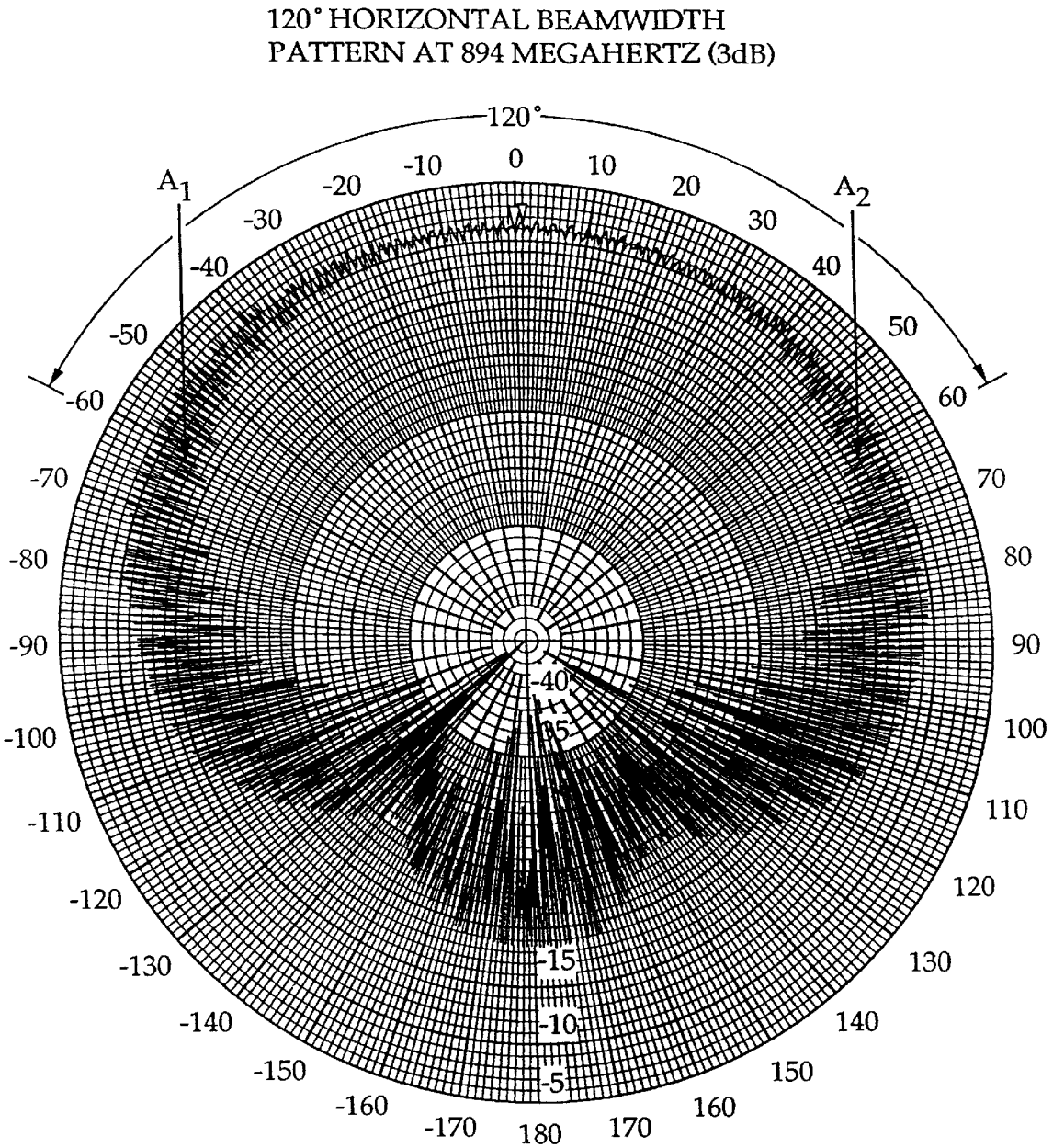
FIG. 29 shows a radiation pattern generated by the antenna at 824 MHz.
Figure 30:
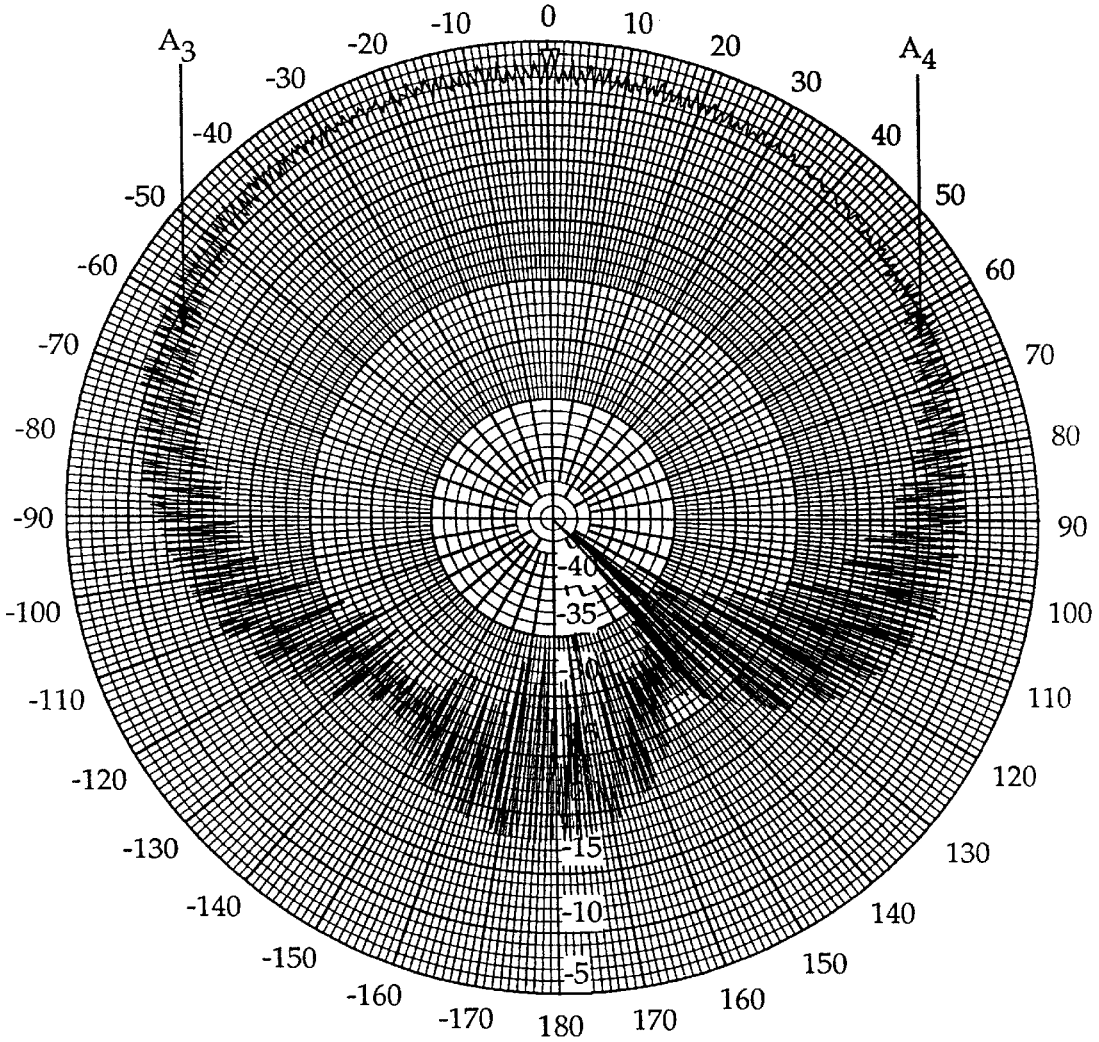
FIG. 30 shows a radiation pattern generated by the antenna at 859 MHz.
Figure 31:
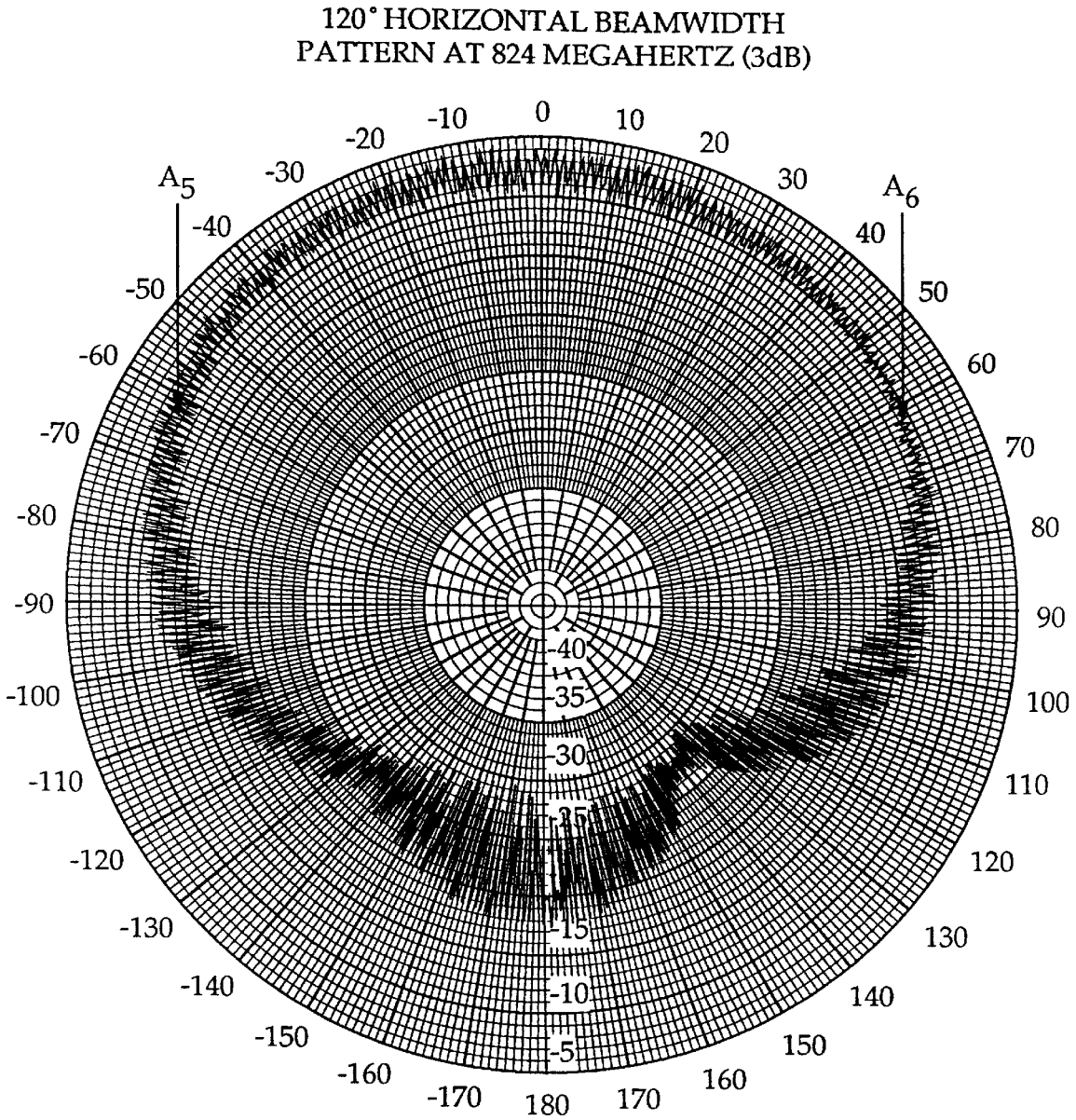
FIG. 31 shows a radiation pattern generated by the antenna at 894 MHz.

As shown, the antenna 100 consists of a vertical array, generally indicated as 105, of pairs of crossed one-half wavelength dipoles generally indicated as 110, 120, 130, 140 are connected to a reflector plate 115 and a single microfeed transmission line generally indicated as 200 for providing a circularly polarized 120 degrees horizontal beamwidth radiation pattern shown in FIGS. 29–31. The vertical array 105 of the pairs of crossed dipoles 110, 120, 130, 140 are dimensioned with respect to the reflector box 115 and the single microfeed transmission line 200 to provide a 120 degree beamwidth pattern, similar to that disclosed in U.S. Pat. No. 5,274,391 hereby incorporated by reference.

The Binary Feed Network and Microstrip Transmission Line

In particular, U.S. Pat. No. 5,274,391 shows and describes a broadband directional antenna having a vertical array of dipoles connected to a binary feed network with a microstrip transmission line. The single microfeed transmission line 200 of the instant application is similar in design to the binary feed network with a microstrip transmission line shown in U.S. Pat. No. 5,274,391.

Figure 21:
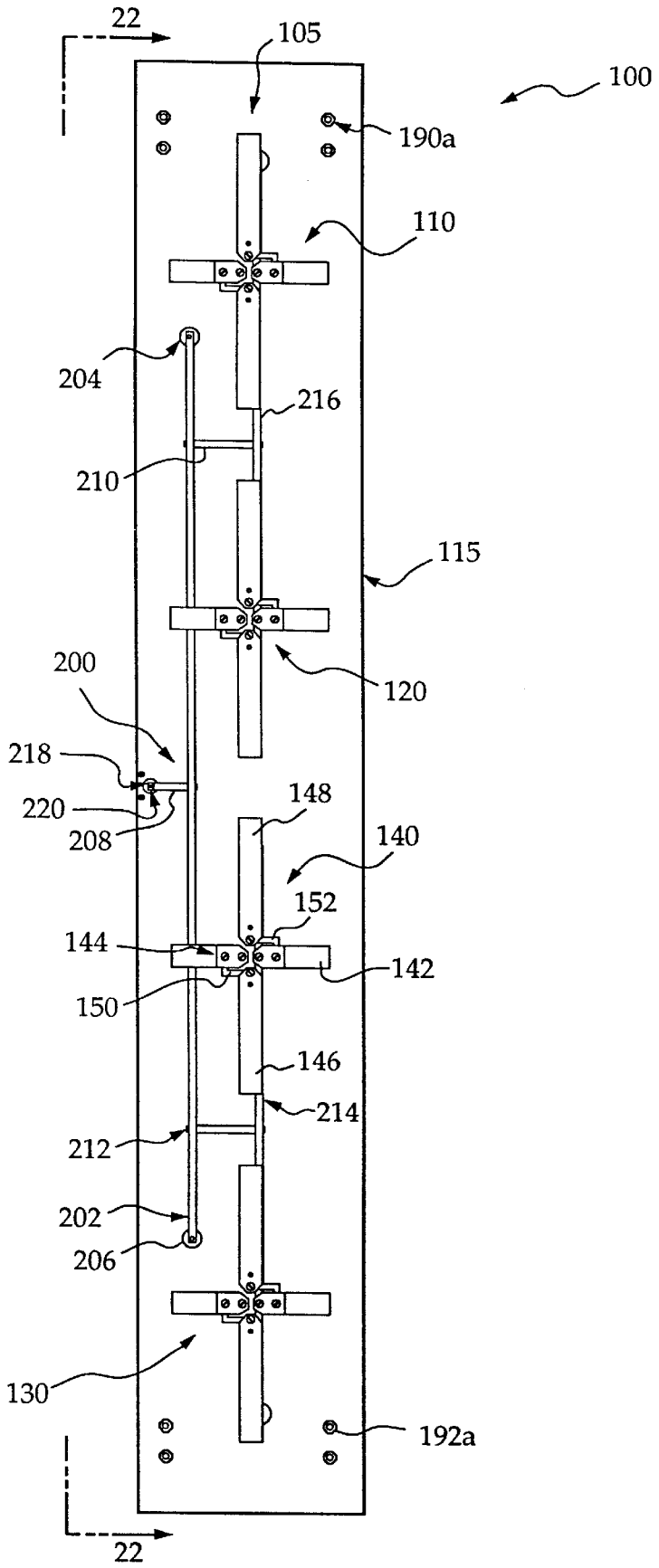
FIG. 21 shows a plan view of another embodiment of an antenna which is the subject matter of the present invention.
Figure 22:
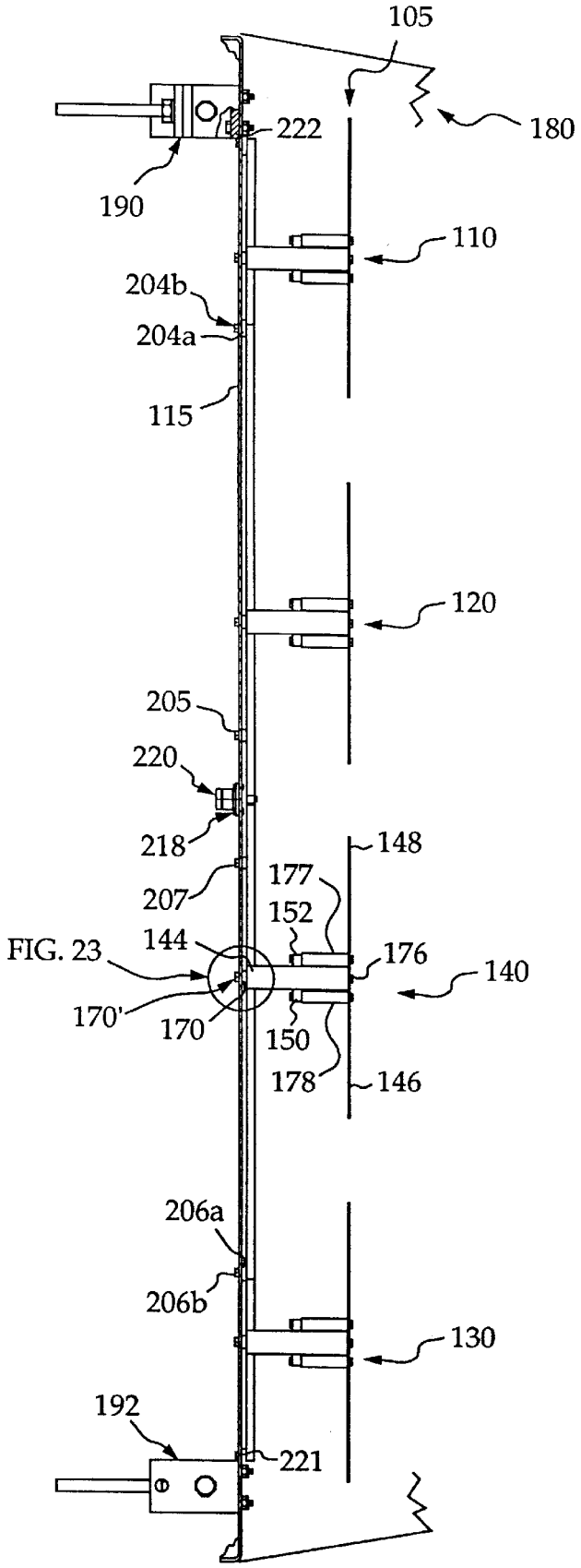
FIG. 22 shows a side view of the antenna shown in FIG. 21 in the direction of arrows 22, 22' in FIG. 21.

As shown in FIGS. 21 and 22 of the instant application, the single microfeed transmission line 200 includes a main conductor bar 202 connected to the open reflector plate 115 on each end to shorting blocks generally indicated as 204, 206, which include spacers 204*a*, 206*a*, and screws 204*b*, 206*b*. The main conductor bar 202 is also connected to conductor bars 208, 210, 212, 214, 216. The conductor bar 208 is connected to an N connector 218 arranged in the open reflector box 115. The N connector 218 has an electrical socket for receiving an input signal. As best shown in FIG. 22, the conductor bars 216 and 214 are also similarly connected by spacers and screws generally indicated as 221, 222, 205 and 207. The dimensions of the vertical array 105, the open reflector plate 115, and the single microfeed transmission line 200 are suitably adapted to provide a desirable circularly polarized horizontal beamwidth radiation pattern for the particular antenna design.

The Pair of Crossed, One-Half Wavelength, Dipoles 140

As shown in FIG. 21, the vertical array 105 includes the pair of crossed, one-half wavelength, dipoles 110, 120, 130, 140 of which the pair of crossed, one-half wavelength, dipoles 140 is representative. The pair of crossed, one-half wavelength, dipoles 140 has a primary dipole with two downwardly bent radiating elements 142, 144 and a secondary dipole with two straight radiating elements 146, 148. (The radiating elements are also referred to as "arms" above.) As shown, the primary dipole is horizontally arranged and the secondary dipole is vertically arranged, although the scope of the invention is not intended to be limited in this regard. As shown, each radiating element 142, 144 of the primary dipole is downwardly bent with respect to the open reflector box 115. As discussed in more detail below, the primary dipoles 142, 144 are also dimensioned with respect to the reflector box 115 and microfeed transmission line 200 to provide a 120 degree beamwidth pattern in the horizontal direction.

As also shown, the radiating elements 146, 148 are straight and parallel to the open reflector box 115. The secondary dipoles 146, 148 are dimensioned with respect to the reflector box 115 and the microfeed transmission line 200 to provide a 120 degree beamwidth pattern in the vertical direction. The scope of the invention is not intended to be limited to the dimensions of the radiating elements 146, 148, or their dimensions with respect to the reflector box 115 and the microfeed transmission line 200.

The downwardly bent radiating element 144 of the primary dipole is connected to the straight radiating element 146 by a primary-to-secondary dipole phase loop element 150, and the downwardly bent radiating element 142 of the primary dipole is connected to the straight radiating element 148 by a primary-to-secondary dipole phase loop element 152. The primary-to-secondary dipole phase loop elements 150, 152 are connected between the respective radiating elements 142, 148; 144, 146 to provide phase quadrature in the straight radiating elements 146, 148 of the secondary dipole for providing circular polarization in the radio frequency signal generated by the antenna 100. The circular polarization of such a pair of crossed dipoles is known in the art, and is also discussed above in more detail with respect to the embodiment shown in FIGS. 1–20.

Figure 23:
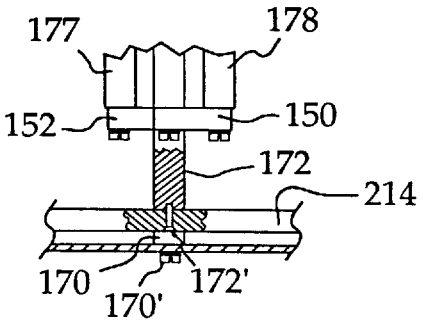
FIG. 23 is a partial cross-section of the crossed dipoles 140 shown in FIG. 22.
Figure 24:
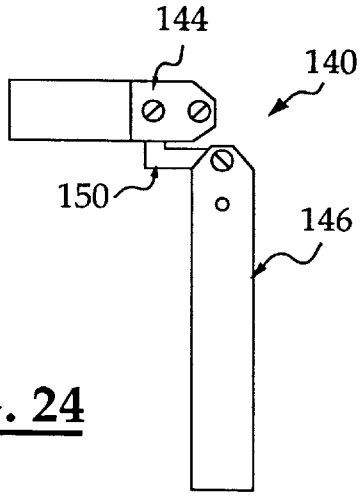
FIG. 24 is a partial top view of the cross dipole 140 in FIG. 21.
Figure 25:
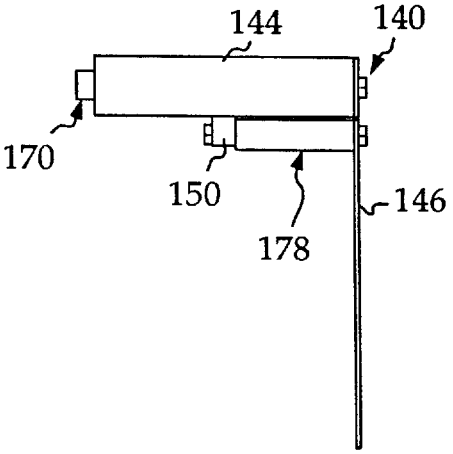
FIG. 25 shows a partial side view of the crossed dipole 140.
Figure 26:
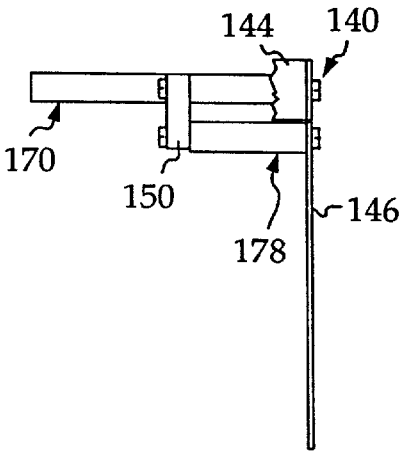
FIG. 26 shows a partial cutaway side view of the crossed dipole 140 shown in FIG. 25.

As shown in FIG. 22, the pair of crossed, one-half wavelength, dipoles 140 also includes a primary dipole standoff 170 connected to the open reflector plate 115 so as to be grounded by screw 170', and connected to the downwardly bent radiating element 144 of the primary dipole by a screw 176. FIG. 23 shows the other downwardly bent radiating element 142 of the primary dipole connected by a primary dipole standoff 172 and a screw 172' to the conductor 214 of the microfeed transmission line 200. Moreover, the straight radiating elements 146, 148 of the secondary dipole are connected to the primary-to-secondary dipole phase loop elements 150, 152 by secondary dipole standoffs 177, 178.

Figure 27:
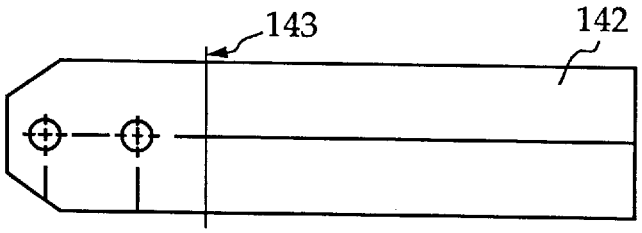
FIG. 27 shows a plan view of a bent dipole 142.
Figure 28:
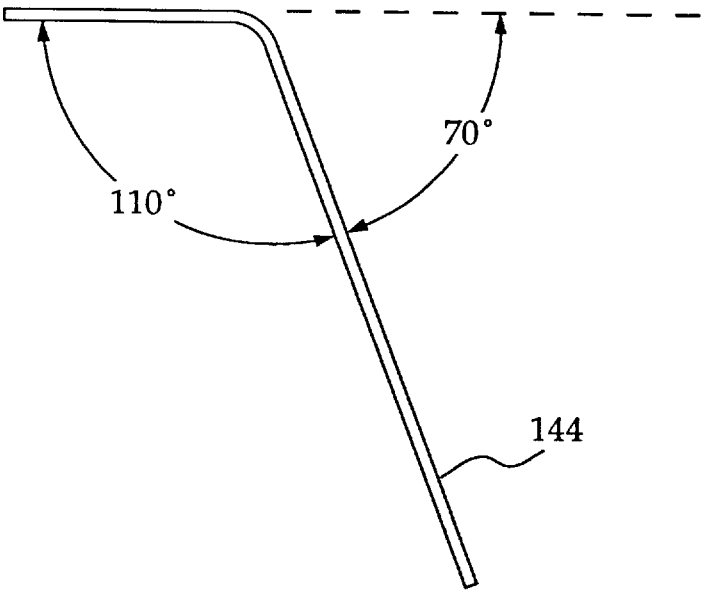
FIG. 28 shows a side view of the bent dipole 142 shown in FIG. 27.

In one embodiment, each pair of downwardly bent radiating elements 142, 144 of the primary dipole is bent at a 70 degree angle (see also FIGS. 27, 28) with respect to the reflector box 115, for providing a 120 degree beamwidth pattern in the horizontal direction, as shown in FIGS. 29–31. In effect, the downward bend of the radiating elements 142, 144 is one important parameter used to determine the width of the horizontal beamwidth pattern. In FIG. 27, the radiating element 142 is indicated to be downwardly bent at line 143. However, the scope of the invention is not intended to be limited to a specific downward angle of the radiating elements 142, 144 of the primary dipole, or where the bend is positioned on the downwardly bent radiating elements 142, 144. Embodiments are envisioned wherein the downwardly bent radiating elements 142, 144 of the primary dipole are bent at angles other than 70 degrees, for example, for providing a wider or narrower beamwidth pattern in the horizontal direction depending on the dimensions of the reflector box 115 and the microfeed transmission line. In addition, the scope of the invention is not intended to be limited to only a downward bend in the radiating elements of the primary dipole, because embodiments are envisioned in which the radiating elements of the primary dipole are bent upwardly, for providing a narrower horizontal beamwidth than that shown herein.

FIG. 29 shows a radiation pattern generated by the antenna at 894 MHz showing an approximate 120 degree horizontal beamwidth pattern at 3 Db indicated by the arrowheads $A_1$, $A_2$.

FIG. 30 shows a radiation pattern generated by the antenna at 859 MHz showing an approximate 120 degree horizontal beamwidth pattern at 3 dB indicated by the arrowheads $A_3$, $A_4$.

FIG. 31 shows a radiation pattern generated by the antenna at 824 MHz showing an approximate 120 degree horizontal beamwidth pattern at 3 dB indicated by the arrowheads $A_5$, $A_6$.

As shown in FIGS. 21 and 22, the pairs of crossed, one-half wavelength, dipoles 110, 120 and 130 are similar in design and structure to the pair of crossed one-half wavelength dipoles 140, and therefore not labelled.

As shown in FIGS. 21 and 22, the antenna 100 also includes a radome 180, an upper bracket 190 and a lower bracket 192. The upper bracket 190 is connected to the open reflector box 115 by screws generally indicated as 190*a*, and the lower bracket 192 is connected to the open reflector box 115 by screws generally indicated as 192*a*.

It is important to note that the scope of the invention is not intended to be limited to an antenna having any particular dimensions with regard to any of the features of the antenna 100 described above. Any person skilled in the art of making and using such antennae knowing the principals of the invention described above would be able to construct an antenna that would operate within the spirit of the invention without undue experimentation.

With the preferred embodiment of the present circularly polarized antenna 100 now fully described, it can thus be seen that the primary objective set forth above is efficiently attained and, since certain changes may be made in the above described antenna 100 without departing from the scope of the invention, it is intended that all matter contained in the above description or shown in the accompanying drawings shall be interpreted as illustrative and not in a limiting sense.

What is claimed is:

1. A circularly polarized antenna, comprising:

an open reflector box formed of conductive material, having a ground plate and four side walls defining an opening, and having an input port for receiving an input signal;

a single binary feed network disposed within said open reflector box for connecting to the input port, having a microstrip transmission line spaced from the ground plate, the microstrip transmission line having conductive bars mounted parallel to the ground plate and spaced therefrom forming an air spaced dielectric in the form of an air dielectric low loss microstrip; and an array of crossed dipoles, each pair of crossed dipoles having a first dipole with two downwardly bent radiating elements arranged at an angle with respect to the ground plate, and having a second dipole with two straight radiating elements being arranged parallel to the ground plate, each pair of crossed dipoles also has a pair of phase loop connectors for respectively connecting an associated downwardly bent radiating element of the first dipole to a corresponding straight radiating element of the second dipole for providing circular polarization in an axial direction, one of the downwardly bent radiating elements of the first dipole connected to the ground plate, and the other of the downwardly bent radiating elements of the first dipole connected to a respective conductive bar of the single binary feed network, for providing a circularly polarized horizontal beamwidth pattern having a horizontal width determined by the degree of the angle of the downwardly bent radiating elements with respect to the ground plate.

2. A circularly polarized antenna according to claim 1, wherein the first dipole is a primary dipole having downwardly bent radiating elements arranged at an angle of 70 degrees with respect to the ground plate of the open reflector box for producing a horizontally polarized horizontal beamwidth pattern having a width of 120 degrees.

3. A circularly polarized antenna according to claim 1, wherein the second dipole is a secondary dipole.

4. A circularly polarized antenna according to claim 1, wherein the array of crossed dipoles includes four pairs of crossed, one-half wavelength, dipoles.

5. A circularly polarized antenna according to claim 1, wherein each pair of crossed dipoles also has a pair of phase loop connectors and associated standoffs for respectively connecting an associated downwardly bent radiating element of the first dipole to a corresponding straight radiating element of the second dipole for providing the circular polarization in the axial direction with equal currents in phase quadrature.

6. A circularly polarized antenna according to claim 1, wherein the array is a vertical array of crossed, one-half wavelength, dipoles.

7. A circularly polarized antenna according to claim 1, wherein one of the downwardly bent radiating elements of the first dipole is connected to the ground plate, and the other of the downwardly bent radiating elements of the first dipole is connected to a respective conductive bar of the single binary feed network.

* * * * *